United States Patent [19]

Cohen et al.

[11] Patent Number: 4,898,300

[45] Date of Patent: Feb. 6, 1990

[54] MOLDED CLOSEABLE BIN HAVING A SHAPED HOPPER

[75] Inventors: Joel B. Cohen, Gwynedd; Matthew Marhefka, Southampton, both of Pa.

[73] Assignee: Shell Containers, Inc., Ambler, Pa.

[21] Appl. No.: 203,479

[22] Filed: Jun. 6, 1988

[51] Int. Cl.[4] ..... B65D 43/00; B65D 45/00; B65D 51/00

[52] U.S. Cl. ..... 220/334; 220/22; 220/324

[58] Field of Search ..... 220/334, 339, 22, 324

[56] References Cited

U.S. PATENT DOCUMENTS

| | | | |
|---|---|---|---|
| 492,878 | 3/1893 | Sieber | 220/334 |
| 528,355 | 10/1894 | Bain | 220/334 |
| 554,060 | 2/1896 | Greene | 220/22 |
| 607,198 | 7/1898 | Symonds | 220/334 |
| 1,173,002 | 2/1916 | Kennedy | 220/334 |
| 1,642,466 | 9/1927 | Sorensen | 312/117 |
| 2,222,690 | 4/1940 | Shank | 220/22 |
| 2,702,649 | 2/1955 | Neilson | 220/22 |
| 3,407,958 | 10/1968 | Konijnenberg et al. | 220/324 |
| 3,414,157 | 12/1968 | Wright | 220/339 |
| 3,595,433 | 7/1971 | Jones | 220/324 |

*Primary Examiner*—Stephen Marcus
*Assistant Examiner*—Stephen Castellano
*Attorney, Agent, or Firm*—Woodcock Washburn Kurtz Mackiewicz & Norris

[57] ABSTRACT

An improved bin for storing objects and providing better accessibility to the objects when removal is desired. The storage bin is provided with a hinged front wall or hopper having a top portion and a bottom portion. The hopper is shaped so that the top portion and the bottom portion provide a protrusion which extends outward from the front side of the bin in the closed position. When the hopper is in the closed position, the top and bottom portion define the front wall of the bin. When the hopper is in the open position, the bottom portion of the hopper provides a lateral extension of the base of the storage bin and the top portion of the hopper defines a laterally extended, reduced height front wall for the bin. The base of the storage bin is sloped towards the hopper to provide an automatic gravity feed of parts stored therein.

18 Claims, 3 Drawing Sheets

MOLDED CLOSEABLE BIN HAVING A SHAPED HOPPER

BACKGROUND OF THE INVENTION

1. Field of the Invention

This invention relates to a molded closeable bin for holding parts. More specifically this invention relates to a molded closeable bin for holding parts wherein the bin is provided with a hinged shaped hopper to allow a greater volume of parts in the bin to be accessible for removal.

2. Description of the Prior Art

Bins, or other storage compartments, for holding great numbers of parts such as screws or bolts where the user must repeatedly open the bin to access the stored parts are well-known. A typical prior art bin would be rectangularly shaped and have some type of three-sided hopper hinged at the bottom of the bin so that the front of the bin could be opened or closed. The side walls of the hopper are received by the interior of the storage compartment and the front wall of the hopper would act as the front of the bin when closed. When closed, the front wall of the hopper lays flush with the front edges of the sides of the bin.

Several disadvantages in such prior bins exist. First, the side walls of the hopper would often crush parts when closing the bin or permit the parts to interfere with closing of the hopper. Being flush with the sides of the bin in the closed position, the hopper front could crush parts when closed as well. Jamming of the hopper was common when parts became lodged in the path of the hopper side walls.

Besides being disadvantageous in operation, such prior bins failed to adequately satisfy their primary purpose--the storage of parts to provide easy access when needed. When opened, the flat-walled hoppers failed to provide easy access to the parts stored within. Only a small opening was provided, often making the removing of parts difficult. Also, when only a few parts remained in the storage bin, there was no way to access those parts if they were in the rear of the storage compartment without tilting or shaking the bin.

SUMMARY OF THE INVENTION

It is an object of this invention to provide a storage container or bin having a shaped hopper which provides greater accessibility to the parts stored therein.

It is another object of the invention to provide a shaped hopper which will prevent the damaging of parts stored therein when the hopper is closed.

It is yet another object of this invention to provide a storage bin whereby the parts stored therein will not interfere with the opening and closing of the hopper.

Still yet another object of this invention is to provide a storage bin whereby the parts stored therein are automatically fed towards the front of the bin as they are removed.

In accordance with the objects and principles of this invention, a rectangularly shaped storage bin is provided having a hinged front wall, or hopper, hinged to the bottom wall and which rotates between closed and open positions. The hopper includes side walls which are received in slot-shaped spaces in the bin and a protruding front side which extends outwardly from the front of the storage bin to provide better accessibility to the contents of the bin. The protruding front side is shaped such that when the hopper is open, the bottom portion of the protruding front side provides a lateral extension of the bottom wall of the storage bin and the top portion of the protruding front side defines a laterally extended, reduced height front wall for the bin.

Interior walls are integrally formed with the top and bottom walls of the bin to provide slot-shaped spaces for receiving the sides of the hopper. The top wall of the storage bin is provided with openings for receiving hooks integrally formed with the sides of the hopper to limit the maximum extension of the hopper during opening of the bin. The side walls of the storage bin are provided with openings for receiving projecting tabs integrally formed with the hopper sides to lock the bin in the closed position. The bottom wall of the bin is sloped towards the front of the hopper to provide for the automatic gravity feeding of parts stored therein.

The above and other objects, advantages, and features of the invention will be more readily understood from the following detailed description of the invention, which is provided in connection with the accompanying drawings.

DESCRIPTION OF THE PREFERRED EMBODIMENT

Figure 1:
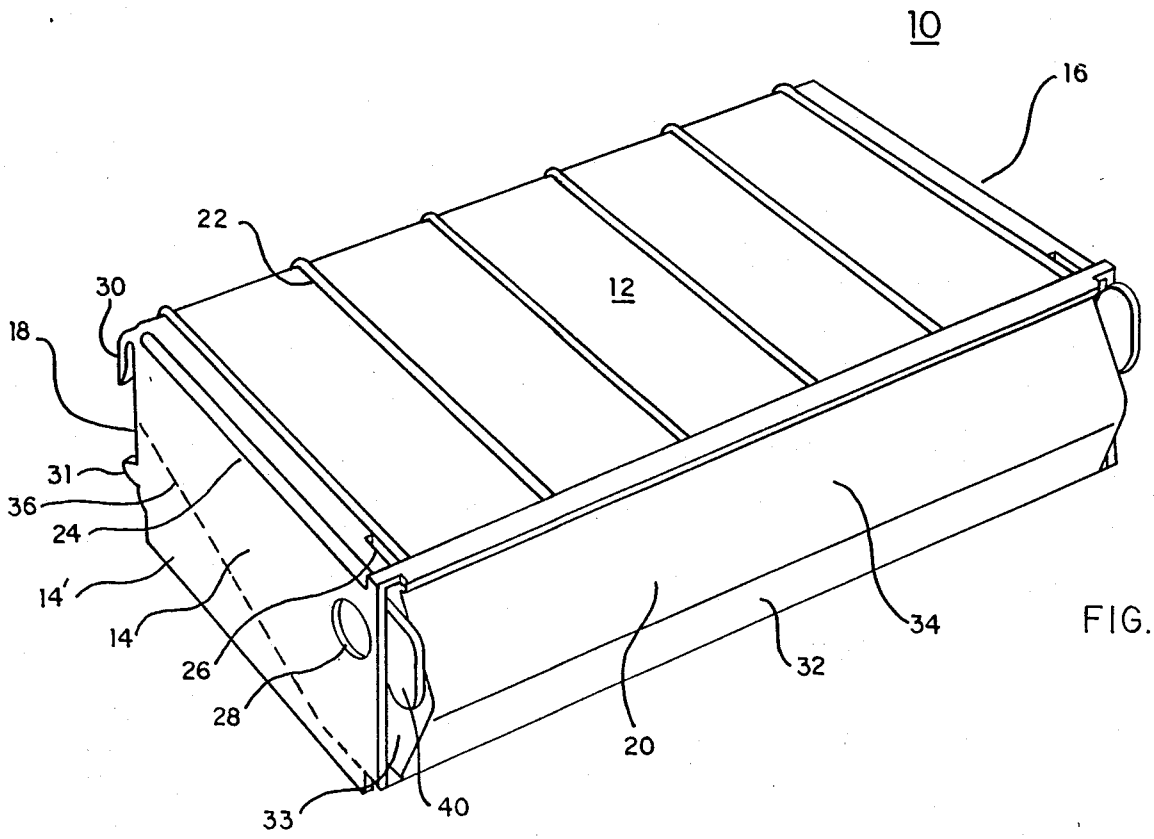
FIG. 1 is a perspective view of the storage bin of the present invention in the closed and locked position.

Turning first to FIG. 1, the storage bin 10 of the present invention may be seen. Storage bin 10 is essentially a one piece, integrally formed bin comprising a top wall 12, exterior side walls 14 and 16, back wall 18, bottom wall 36 and a front hopper 20. Front hopper 20, which provides the front wall for bin !0, is hinged at lower edge 21 to bottom wall 36 in a "living hinge" to permit movement of front hopper 20.

Top wall 12 includes a series of parallel ridges 22 extending from the front edge of the top wall 12 formed thereon. Grooves 24 are formed along the sides of top wall 12 for receiving corresponding feet of another storage bin 10 so that plural storage bins 10 may be securely stacked on top of each other. Top wall 12 further includes openings 26 for receiving hook 47 of front hopper 20 to limit the movement of front hopper 20 in a manner to be more fully described later. Lip 45 is formed along the front edge of top wall 12 for mating with upper edge 44 of hopper 20 when bin 10 is closed.

Each exterior side wall 14, 16 is provided with an opening 28, preferably circular but which may be of any other shape, to lock bin 10 in the closed position by engaging the corresponding hopper side 33, again in a manner to be more fully described later. Towards front hopper 20, bottom wall 36 is joined to exterior side walls 14, 16 near, but not at the bottom of the exterior side walls to define a leg portion 14', 16' for supporting bin 10. As bottom wall 36 is sloped upwardly towards back wall 18, leg portions 14', 16' increase in dimension, i.e. height, towards the back of bin 10.

Back wall 18 is provided with hook means 30 integrally formed therewith and extending along the length of the back wall so that bin 10 may be hung or mounted to a vertical surface (not shown). Back wall 18 is further provided with rear feet 31 for vertical usages of bin 10.

As may be seen in FIG. 1, in the closed position, front hopper 20 acts as a front wall for storage bin 10. Front hopper 20 also provides better visibility of any label or marking that is placed on second portion 34 of front hopper 20 whether bin 10 is open or closed. Front hopper 20 is comprised of first portion 32 and second portion 34 integrally joined at an obtuse angle.

Figure 2:
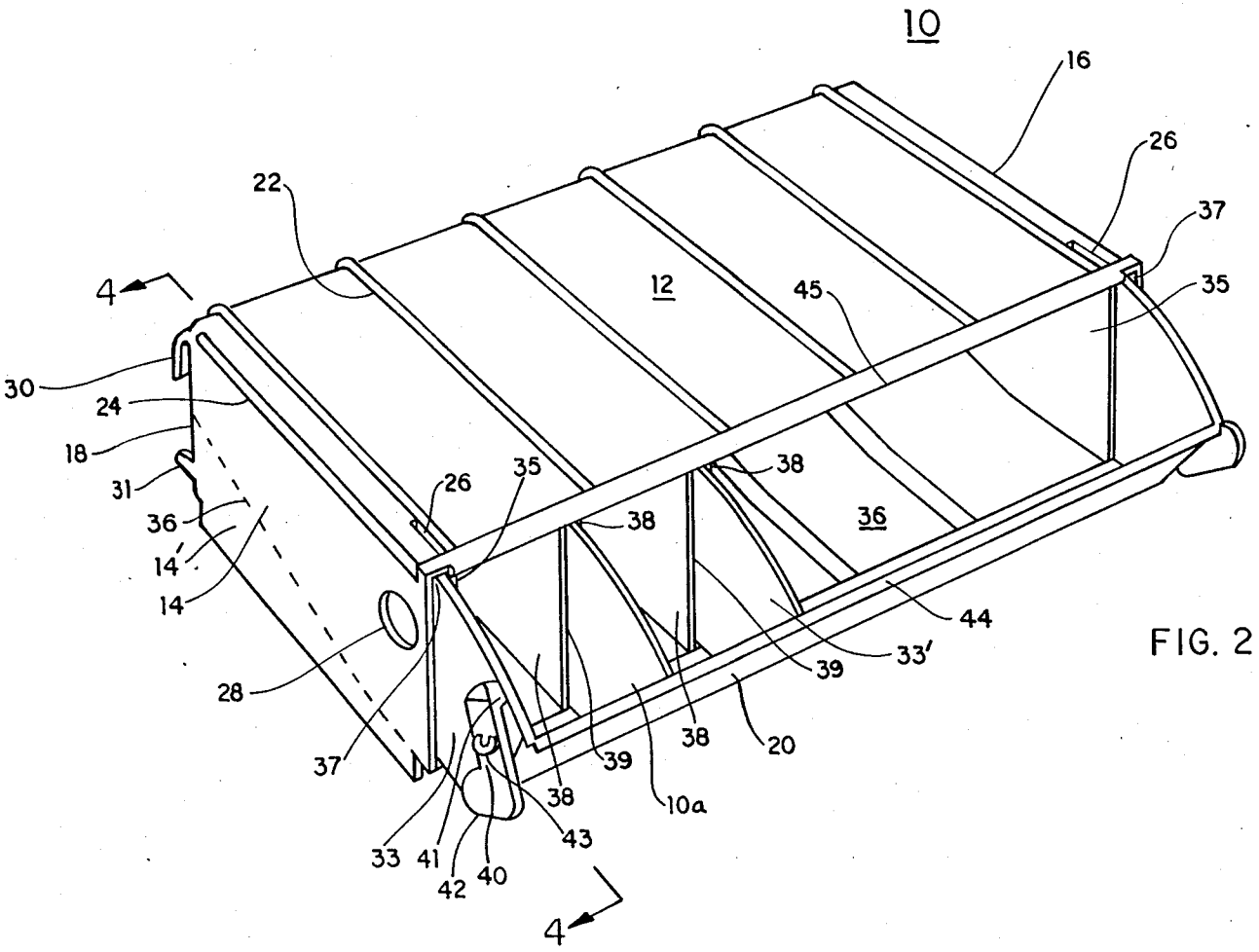
FIG. 2 is a perspective view of the storage bin of FIG. 1 where the hopper has been opened.

Turning next to FIG. 2, storage bin 10 may now be seen in the opened position, thus revealing interior walls 35. A pair of interior walls 35 are integrally formed with the top wall 12 and bottom wall 36 substantially parallel to the corresponding exterior side wall 14, 16 to define a slot-shaped space 37. Top wall 12, back wall 18, bottom wall 36 and interior walls 35 define bin compartment 10*a* for storing objects within bin 10. Additional pairs of interior side walls 38 may be integrally formed with top wall 12 and bottom wall 36 to define additional slot-shaped spaces 39 if it is desired that storage bin 10 has plural compartments so that different types of objects may be stored in separate compartments. Front hopper 20 includes a pair of sides 33 which are received in the slot-shaped spaces 37 located between bin side walls 14, 16 and a corresponding interior wall 35 in the closed position. Each side 33 is provided with a tab portion 40 integrally formed with the corresponding hopper side 33 at base 41 of tab 40. Base 41 extends outwardly from hopper side 33 so that tab portion 40 is displaced slightly from side 33 to define a narrow space therebetween. Tab portion 40 is arranged approximately parallel to side 33 but extends past the end of side 33 where it terminates in a widened portion 42 sized for easy gripping. Widened portions 42 are orientated one up and one down so that access to the tabs is unrestricted when bins are positioned side by side. Projection ridge 43 of shape similar to opening 28 of side wall 14 is formed on tab portion 40 as well.

When closing bin 10, hopper sides 33 are received in the corresponding slot-shaped space 37. Tab portion 40 is compressed inwardly towards side 33. The compression of tab portion 40 is maintained as hopper sides 33 are inserted in slot-shaped space 37 until projection ridge 43 snaps into opening 28 to lock bin 10 in the closed position. To unlock the hopper, widened portion 42 of tab 40 is compressed, i.e. displaced in a directed towards hopper side 33 until projection ridge 43 exits opening 28. Bin 10 may then be opened by subjecting a lateral force on hopper 20 to remove hopper sides 33 from slot-shaped spaces 37 while maintaining tabs 40 in a compressed position. If additional bin compartments are desired, hopper 20 may be formed to include interior hopper walls 33' to be received by an interior slot-shaped space 39 defined by a pair of interior walls 38.

Figure 3:
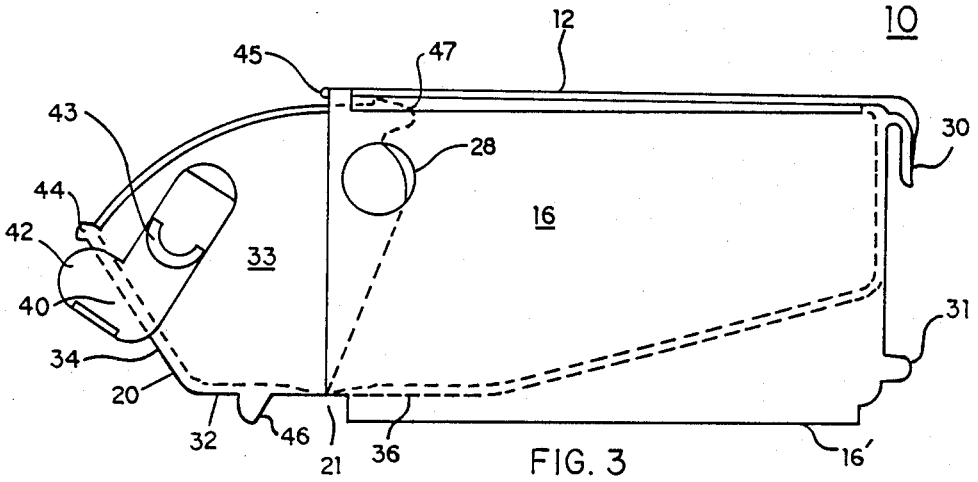
FIG. 3 is side view of the open bin of FIG. 2 which better shows the shaped hopper of the present invention.

Turning next to FIG. 3, a side view of storage bin 10 with hopper 20 fully extended, is shown. The improved access to objects stored in bin 10 after opening of bin 10 may now be clearly seen. In the open position, the first portion 32 of hopper 20 is approximately aligned with bottom wall 36 and provides an extended bottom wall for bin 10. The second portion 34 of hopper 20 defines a front wall for bin 10 which is located forward of the original location of hopper 20 by the length of first portion 32 with the upper edge 44 of second portion 34 positioned substantially lower than lip 45 of top wall 12 as well. Hopper sides 33 define extended side walls of bin 10 as well. While it is contemplated that numerous configurations of hopper 20 will provide the desired improved access, it is preferred that first portion 32 and second portion 3 be integrally joined at an angle of approximately 120 degrees. By joining first portion 32 and second portion 34 at such an angle, second portion 34 will define a front wall for bin 10 which will be angled at approximately 60 degrees from horizontal, thus providing easy access in the contents of bin 10 when opened. Feet 46 are integrally formed as part of hopper side 33 to provide greater security of bin 10 when open. When bin 10 is fully open and first portion 32 is approximately aligned with bottom wall 36, feet 46 point downward such that the ends of feet 46 are aligned with the ends of leg portions 14', 16' of side walls 14, 16. The extension of bin 10 caused by the opening of hopper 20 is supported by feet 46 to provide additional balance to bin 10 and to make tipping of bin 10 less likely. Shown in phantom in FIG. 3 are hooks 47, also formed onto hopper sides 33 to limit the permitted travel of hopper 20. When bin 1 has been opened to the desired full extent, i.e. first portion 32 approximately aligned with bottom wall 36, hooks 47 will engage openings 26 in top wall 12 of bin 10 to prevent any further displacement of hopper 20.

Figure 4:
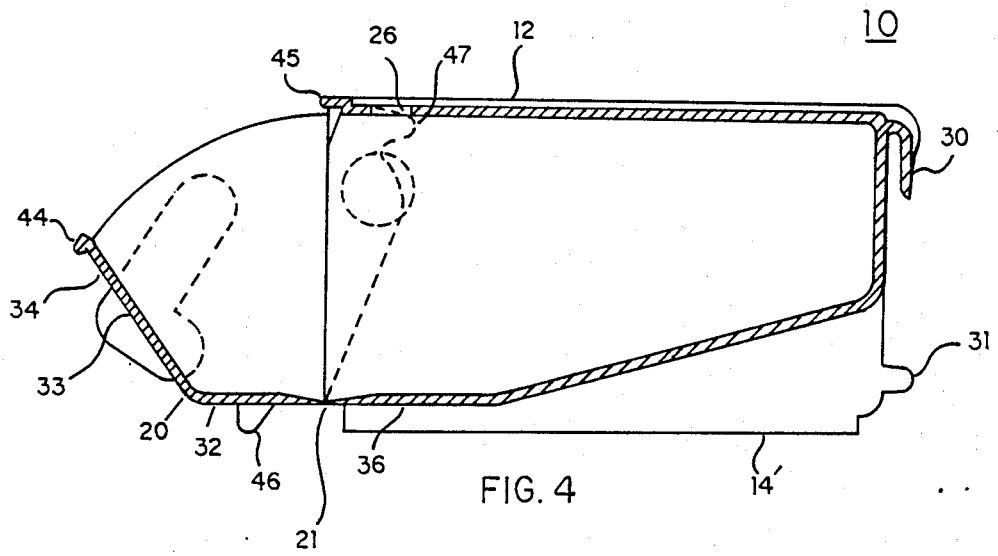
FIG. 4 is a cross-sectional view along lines 4-4 of FIG. 2.

Turning next to FIG. 4, a cross-sectional side view along line 4—4 of FIG. 2 is shown. As may be clearly seen, bottom wall 36 of bin 10 slopes downwardly from back wall 18 and towards hopper so that objects stored in bin 10 may be automatically fed to the front of bin 10 where removal is easiest. As parts are removed from the opened bin, the sloped bottom wall 36 will provide constant feeding of additional parts to the front of bin 10 for removal.

Thus, there has been described and illustrated herein a molded closeable bin having a shaped hopper to allow greater accessibility to parts stored in the bin. However those skilled in the art will recognize that many modifications and variations besides those specifically set forth may be made in the techniques described herein without departing substantially from the concept of the present invention. Accordingly, it should be clearly understood that the form of the invention described herein is exemplary only, and is not intended as a limitation on the scope of the claims.

What is claimed is:

1. An improved bin having a bin compartment for storing objects, said pin providing access to said objects for removal from said bin compartment, comprising:

a bottom wall having a front edge;

first and second exterior side walls integrally formed with said bottom wall;

a top wall having a front edge, said top wall integrally formed with said first and second exterior side walls;

a back wall integrally formed with said first and second exterior side walls and said bottom wall; and a hopper having a pair of hopper side walls and a protruding front with a lower edge and an upper edge, said lower edge of said hopper hangable attached to said front edge of said bottom wall, said hopper being movable between a closed position where said upper edge of said hopper mates with said front edge of said top wall to close said bin and said pair of hopper side walls are received by said protruding front defining a front wall for said bin in said closed position and providing an open position where objects may be removed from outside said bin;

said protruding front of said hopper having first and second portions integrally joined at an angle, said first portion approximately aligned with said bottom wall when said hopper is in said open position, said second portion defining a front wall for said bin when said hopper is in said open position, said pair of hopper side walls defining an extension of said exterior side walls for said bin when said hopper is in said open position, wherein said upper edge of said hopper is formed along an edge of said second portion and said upper edge is spaced away from said front edge of said top wall when said hopper is in said open position.

2. Bin according to claim 1 wherein said bottom wall slopes toward said front edge of said bottom wall.

3. Bin according to claim 2 wherein said first and second exterior side walls further comprise projecting legs.

4. Bin according to claim 3 wherein said first portion further comprises projecting legs, said projecting legs of said first portion approximately aligned with said projecting legs of said first and second exterior side walls when said hopper is in said open position.

5. Bin according to claim 1 further comprising first and second interior side walls integrally formed with said top wall and said bottom wall, said first and second interior side walls substantially parallel with said first and second exterior side walls, said first and second interior side walls defining a bin compartment for said bin.

6. Bin according to claim 1 wherein said first and second portions of said protruding front are integrally joined at an angle of approximately 120 degrees.

7. Bin according to claim 1 further comprising first and second interior side walls integrally formed with said top wall and said bottom wall, said first interior side wall substantially parallel with said first exterior side wall and defining therebetween a first slot-shaped space for receiving one of said pair of hopper side walls, said second interior side wall substantially parallel with said second exterior side wall and defining therebetween a second slot-shaped space for receiving another of said pair of hopper side walls.

8. Bin according to claim 7 wherein said top wall further comprises a pair of parallel slots and said hopper further comprises a first hook integrally formed with said one of said pair of hopper side walls and a second hook integrally formed with said another of said pair of hopper side walls, said first and second hooks being received by a corresponding one of said pair of parallel slots to limit the extent of permitted travel of said hopper.

9. Bin according to claim 7 wherein said hopper further comprises projecting tabs integrally formed with said hopper side walls, said projecting tabs engaging said exterior side walls to lock said hopper into said closed position.

10. Bin according to claim 9 wherein said projecting tabs further include tab release means integrally formed with said projecting tabs for releasing said engagement between said exterior side walls and said projecting tabs.

11. An improved bin having a bin compartment for storing objects, said bin providing access to said objects for removal from said bin compartment, comprising:

a bottom wall having a front edge;

first and second exterior side walls integrally formed with said bottom wall;

first and second interior side walls integrally formed with said bottom wall, said first interior side wall substantially parallel with said first exterior side wall to define a first slot-shaped opening and said second interior side wall substantially parallel with said second exterior side wall to define a second slot-shaped opening;

a top wall having a front edge, said top wall integrally formed with said first and second exterior side walls and said first and second interior side walls;

a back wall integrally formed with said first and second exterior side walls, said first and second interior walls and said bottom wall, said back wall, top wall, bottom wall and said first and second interior side walls defining said bin compartment; and a hopper having a first hopper side wall, a second hopper side wall and a protruding front with a lower edge and an upper edge, said lower edge of said hopper hingeably attached to said front edge of said bottom wall, said hopper being movable between a closed position where said upper edge of said hopper mates with said front edge of said top wall to close said bin, said first hopper side wall being received by said first slot-shaped opening in said closed position and said second hopper side wall being received by said second slot-shaped opening in said closed position, said protruding front defining a front wall for said bin in said closed position, and an open position where objects may be removed from outside said bin;

said protruding front of said hopper having first and second portions integrally joined at an angle, said first portion approximately aligned with said bottom wall when said hopper is in said open position, said second portion defining a front wall for said bin when said hopper is in said open position, said first and second hopper side walls defining an extension of said exterior side walls for said bin when said hopper is in said open position, wherein said upper edge of said hopper is formed along an edge of said second portion and said upper edge is spaced away from said front edge of said top wall when said hopper is in said open position.

12. Bin according to claim 11 wherein said top wall further includes a pair of grooves formed substantially parallel to said exterior side walls and said exterior side walls further comprise projecting legs, wherein multiple bins may be nested together, one on top of another.

13. Bin according to claim 11 wherein said bottom wall slopes towards said front edge of said bottom wall.

14. Bin according to claim 12 wherein said first portion further comprises projecting legs, said projecting legs of said first portion approximately aligned with said projecting legs of said first and second exterior side walls when said hopper is in said open position.

15. Bin according to claim 11 wherein said first and second portions of said protruding front are integrally joined at an angle of approximately 120 degrees.

16. Bin according to claim 11 wherein said top wall further comprises a pair of parallel slots and said hopper further comprises a first hook integrally formed with said first hopper side wall and a second hook integrally formed with said second hopper side wall, said first and second hooks being received by a corresponding one of said pair of parallel slots to limit the extent of permitted travel of said hopper.

17. Bin according to claim 11 wherein said hopper further comprises projecting tabs integrally formed with said hopper side walls, said projecting tabs engaging said exterior side walls to lock said hopper into said closed position.

18. Bin according to claim 17 wherein said projecting tabs further include tab release means integrally formed with said projecting tabs for releasing said engagement between said exterior side walls and said projecting tabs.

* * * * *